US010799750B2

(12) United States Patent
Baumler et al.

(10) Patent No.: US 10,799,750 B2
(45) Date of Patent: Oct. 13, 2020

(54) WEIGHT TRAINING SLED

(71) Applicant: TORQUE FITNESS, LLC, Coon Rapids, MN (US)

(72) Inventors: Thomas K. Baumler, Ramsey, MN (US); Michael G. Novak, Fridley, MN (US); Charles J. Rosenow, Ramsey, MN (US)

(73) Assignee: Torque Fitness, LLC, Coon Rapids, MN (US)

( * ) Notice: Subject to any disclaimer, the term of this patent is extended or adjusted under 35 U.S.C. 154(b) by 54 days.

(21) Appl. No.: 16/072,312

(22) PCT Filed: Feb. 2, 2017

(86) PCT No.: PCT/US2017/016228
§ 371 (c)(1),
(2) Date: Jul. 24, 2018

(87) PCT Pub. No.: WO2017/136560
PCT Pub. Date: Aug. 10, 2017

(65) Prior Publication Data

US 2019/0329083 A1 Oct. 31, 2019

Related U.S. Application Data

(60) Provisional application No. 62/310,175, filed on Mar. 18, 2016, provisional application No. 62/291,558, filed on Feb. 5, 2016.

(51) Int. Cl.
*A63B 21/06* (2006.01)
*A63B 22/20* (2006.01)
(Continued)

(52) U.S. Cl.
CPC ..... *A63B 21/0618* (2013.01); *A63B 21/0004* (2013.01); *A63B 21/0056* (2013.01);
(Continued)

(58) Field of Classification Search
CPC ... A63B 21/0618; A63B 23/047; A63B 21/06; A63B 21/0004; A63B 21/0056;
(Continued)

(56) References Cited

U.S. PATENT DOCUMENTS 2,973,203 A * 2/1961 Taylor ..... B62B 1/18 482/97
3,007,699 A * 11/1961 Taylor ..... A63B 21/4035 482/97

(Continued)

FOREIGN PATENT DOCUMENTS

WO 2011150519 A2 12/2011

OTHER PUBLICATIONS https://web.archive.org/web/20151026132542/http://www.armoredfitness.com:80/.

*Primary Examiner* — Garrett K Atkinson
(74) *Attorney, Agent, or Firm* — Sherrill Law Offices, PLLC

(57) ABSTRACT

A weight training sled (100) characterized by one or more of (A) rotatable wheels (130) in contact with ground, (B) curvilinear push handles (140) with comfortably spaced, and inwardly and/or downwardly angled hand grips (143), and (C) an elevated tow hook (160).

12 Claims, 15 Drawing Sheets

(51) Int. Cl.

| | |
|---|---|
| ***A63B 21/00*** | (2006.01) |
| ***A63B 23/04*** | (2006.01) |
| ***A63B 21/005*** | (2006.01) |
| ***A63B 21/008*** | (2006.01) |
| ***A63B 21/015*** | (2006.01) |

(52) U.S. Cl.
CPC ..... *A63B 21/06* (2013.01); *A63B 21/4035* (2015.10); *A63B 22/20* (2013.01); *A63B 23/047* (2013.01); *A63B 21/005* (2013.01); *A63B 21/008* (2013.01); *A63B 21/0051* (2013.01); *A63B 21/0058* (2013.01); *A63B 21/00065* (2013.01); *A63B 21/00192* (2013.01); *A63B 21/015* (2013.01)

(58) Field of Classification Search
CPC ... A63B 21/4035; A63B 22/20; A63B 21/015; A63B 21/008; A63B 21/0058; A63B 21/0051; A63B 21/005; A63B 21/00192; A63B 21/00065
See application file for complete search history.

(56) References Cited

U.S. PATENT DOCUMENTS 3,062,548 A * 11/1962 Foster ..... A63B 69/345 473/445
3,326,553 A * 6/1967 Forrest ..... A63B 69/345 473/445
3,684,283 A * 8/1972 Forrest ..... A63B 69/345 473/445
4,302,023 A * 11/1981 Kiesz ..... B62B 3/02 108/106
4,451,037 A * 5/1984 O'Hare ..... A63B 69/345 473/445
4,867,439 A * 9/1989 Salyer ..... A63B 21/0618 482/68
5,287,240 A 2/1994 Koizumi et al.
5,454,577 A * 10/1995 Bell ..... B62B 3/02 280/204
5,810,697 A * 9/1998 Joiner ..... A63B 21/06 280/47.371
5,927,732 A * 7/1999 Snyder ..... A63C 17/01 280/87.01
6,086,517 A * 7/2000 Schapmire ..... A63B 21/015 482/68
6,190,293 B1 2/2001 Schuyler et al.
6,276,700 B1 * 8/2001 Way ..... B62B 15/008 280/267
6,287,240 B1 * 9/2001 Trabbic ..... A63B 21/015 482/51
6,302,421 B1 * 10/2001 Lee ..... A61G 5/023 280/210
6,761,650 B1 * 7/2004 Dettmann ..... A63B 69/345 473/441
6,942,585 B1 * 9/2005 Krause ..... A63B 69/002 473/445
7,562,729 B2 * 7/2009 Hammerle ..... B60R 25/00 180/65.1
7,678,026 B2 * 3/2010 Lewis ..... A63B 21/0618 482/65
7,972,224 B2 7/2011 Gilman
7,985,166 B2 7/2011 Farnsworth et al.
8,328,664 B2 * 12/2012 Krause ..... A63B 21/0618 473/438
8,469,861 B1 * 6/2013 McFee ..... A63B 21/0059 482/4
8,617,007 B2 * 12/2013 Gilman ..... A63B 69/00 473/441
9,017,223 B2 4/2015 Eschenbach
9,126,611 B2 * 9/2015 Liu ..... B62B 5/067
9,192,803 B2 * 11/2015 Cayo ..... A63B 21/0618
9,604,086 B2 * 3/2017 Meredith ..... A63B 21/062
9,610,989 B2 * 4/2017 Marchetti ..... B62D 63/061
9,643,040 B1 * 5/2017 Guerrero Diaz ... A63B 21/4005
10,220,233 B2 * 3/2019 Schmidt ..... A63B 21/00065
2002/0109399 A1 * 8/2002 Papac ..... A61G 5/00 301/111.01
2004/0002413 A1 1/2004 Wimber
2005/0164850 A1 * 7/2005 Leibowitz ..... A63B 5/16 482/93
2005/0272572 A1 * 12/2005 Lewis ..... A63B 21/0618 482/93
2007/0249472 A1 * 10/2007 Frei ..... A45B 1/02 482/66
2008/0081741 A1 * 4/2008 Sargen ..... A63B 22/001 482/52
2010/0203986 A1 * 8/2010 Gilman ..... A63B 21/06 473/445
2010/0240499 A1 * 9/2010 Lewis ..... A63B 21/0618 482/74
2013/0143719 A1 * 6/2013 Selek ..... A63B 23/16 482/49
2013/0172159 A1 * 7/2013 Stewart ..... A63B 21/0004 482/112
2014/0073491 A1 * 3/2014 Gilson ..... A63B 21/06 482/93
2014/0206508 A1 7/2014 Hall
2014/0221131 A1 * 8/2014 Gilman ..... A63B 69/00 473/447
2017/0189733 A1 * 7/2017 Bentley ..... A63B 21/06
2017/0313334 A1 * 11/2017 Ryan ..... B62B 3/02
2017/0326402 A1 * 11/2017 Sorin ..... A63B 21/026
2018/0243597 A1 * 8/2018 Schlegel ..... A63B 69/345
2018/0311522 A1 * 11/2018 Schmidt ..... A63B 69/345

* cited by examiner

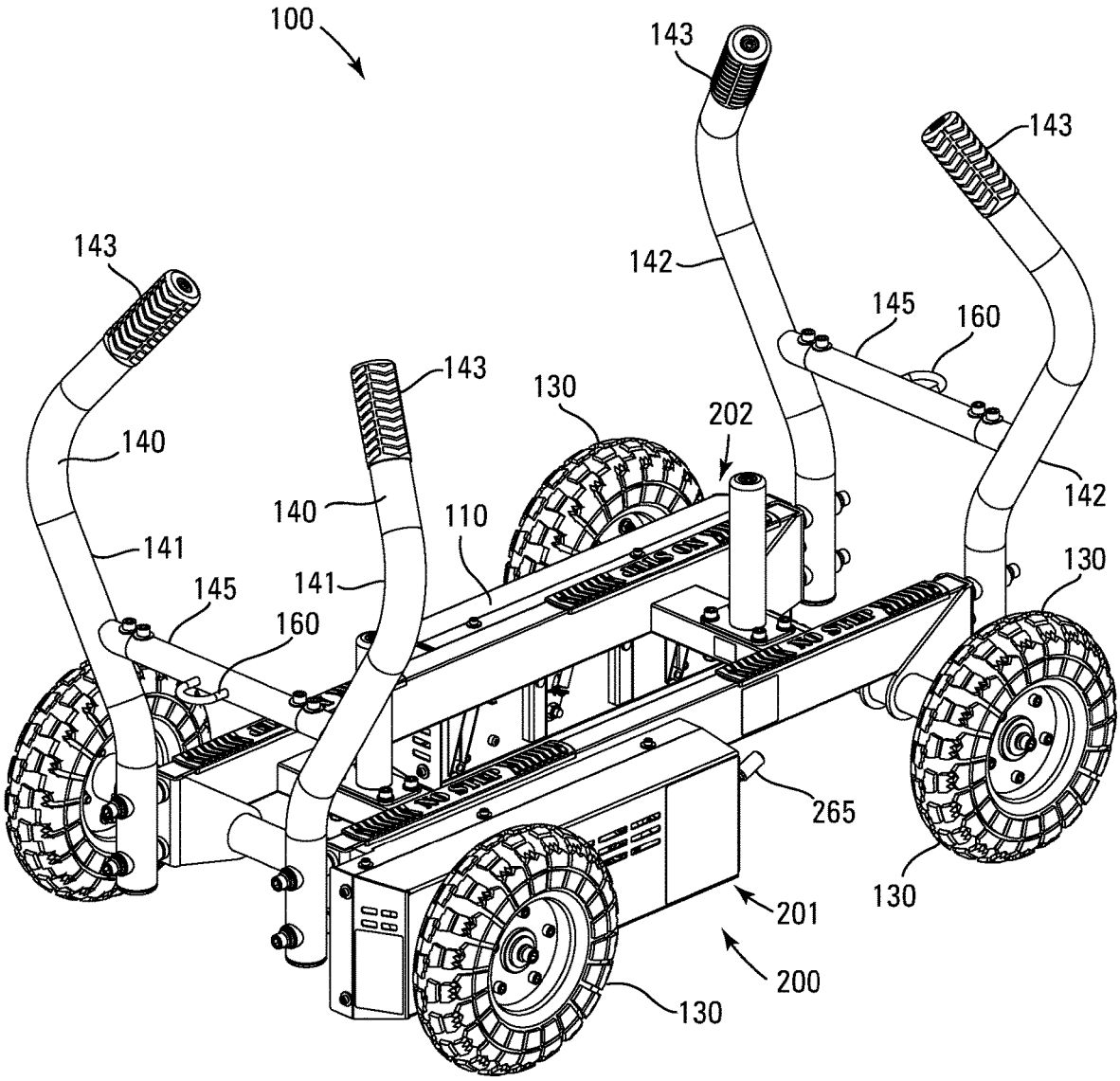
Fig. 8
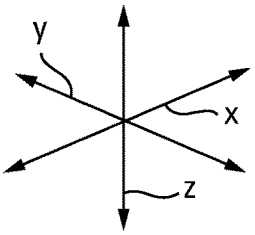

WEIGHT TRAINING SLED

BACKGROUND

Weight sleds have become an increasingly popular exercise device in indoor health and fitness clubs, many of which have limited open space. Weight sleds, also known as blocking sleds, typically support weights upon one or more skids which exert frictional resistance against movement of the sled. An exemplary traditional weight sled is depicted in US Patent Application Publication 2014/0073492. Weight sleds were originally designed for outdoor use where space and the damage caused by the frictional sliding of the skids against the ground were of little concern. The transition from outdoor to indoor use has come with certain challenges, including the need for substantial open space and installation of flooring that can withstand the abrasive effects of repetitive frictional sliding of the skids over the flooring.

Wheeled version of blocking sleds are depicted in U.S. Pat. No. 3,326,553 (a three wheeled skid-steer version) and U.S. Pat. No. 6,942,585 (a single wheel version) whereby frictional skidding is substantially eliminated, but at the expense of a loss in stability when pushing the sled—resulting in the need for an onboard operator to steer the sled of U.S. Pat. No. 3,326,553, or the need for additional space to accommodate the uncontrolled instability of the sled of U.S. Pat. No. 6,942,585.

Accordingly, a need exists for a weight sled designed for safe, nondestructive use in a confined indoor space.

Furthermore, traditional weight sleds suffer from a tendency to tilt forward during use, with the user lifting the work end of the sled (i.e., the end contacted by the exerciser) off the ground resulting in a loss of traction. While desired for certain limited training exercises, such as the teaching of proper blocking technique where application of a lifting force vector is desired, this variable decrease in traction is generally disfavored as it decreases the resistive exercise value of the sled.

Accordingly, a need also exists for a weight sled that remains fully and firmly in resistive contact with the ground during normal and intended use.

SUMMARY OF THE INVENTION

The invention is directed to a weight training sled.

In a first embodiment, the weight training sled is a wheeled weight training sled that includes (a) a chassis having longitudinally spaced first and second ends and laterally spaced first and second sides, (b) at least two longitudinally spaced, fixed-directional wheels for supporting the chassis upon a surface and rotatable for effecting reciprocating travel of the chassis along a substantially linear longitudinal path, (c) a brake for applying bidirectional resistance to rotation of at least one of the wheels, and (d) a pair of laterally spaced push handles extending upward from proximate a first longitudinal end of the chassis.

A preferred version of the first embodiment of the wheeled weight training sled is a tandem axle four wheeled weight training sled that include (a) a chassis having longitudinally spaced first and second ends and laterally spaced first and second sides, (b) a pair of wheels mounted on each of two axles, the wheels supporting the chassis upon a surface and rotatable for effecting reciprocating travel of the chassis along a longitudinal path, (c) a brake for applying resistance to rotation of at least one of the axles, and (d) a pair of laterally spaced push handles extending upward from proximate a first longitudinal end of the chassis.

In a second embodiment, the weight training sled includes (a) a chassis having longitudinally spaced first and second ends and laterally spaced first and second sides, (b) at least three ground-contact travel appliances for supporting the chassis a vertical distance above a support surface, and (c) a pair of laterally spaced push handles attached to and extending vertically upward from proximate a first longitudinal end of the chassis, with a portion of each push handle distal to the chassis angled at least 10° downward towards the chassis relative to vertical.

In a third embodiment, the weight training sled includes (a) a chassis having longitudinally spaced first and second ends and laterally spaced first and second sides, (b) at least two ground-contact travel appliances for supporting the chassis a vertical distance above a support surface, and (c) a first pair of laterally spaced push handles attached to and extending vertically upward from proximate a first longitudinal end of the chassis, with a portion of each push handle distal to the chassis angled at least 10° inward towards the other push handle relative to vertical.

In a fourth embodiment, the weight training sled includes (a) a chassis having longitudinally spaced first and second ends and laterally spaced first and second sides, (b) at least two ground-contact travel appliances for supporting the chassis a vertical distance above a support surface, and (c) a pair of laterally spaced push handles attached to and extending vertically upward from proximate a first longitudinal end of the chassis, with the push handles defining a laterally extending gap between axial centers of the push handles whose lateral width increases along a first length of the push handles closer to the chassis, and decreases along a second length of the push handles further from the chassis.

In a fifth embodiment, the weight training sled includes (a) a chassis having longitudinally spaced first and second ends and laterally spaced first and second sides, (b) at least two ground-contact travel appliances for supporting the chassis a vertical distance above a support surface, and (c) a tow hook operable for attachment of a tow rope, spaced at least 30 cm above a support surface upon which the sled is supported.

BRIEF DESCRIPTION OF THE DRAWINGS

FIG. 8 is a perspective view of another embodiment of the invention.

DETAILED DESCRIPTION OF A PREFERRED EMBODIMENT

Definitions

Figure 1:
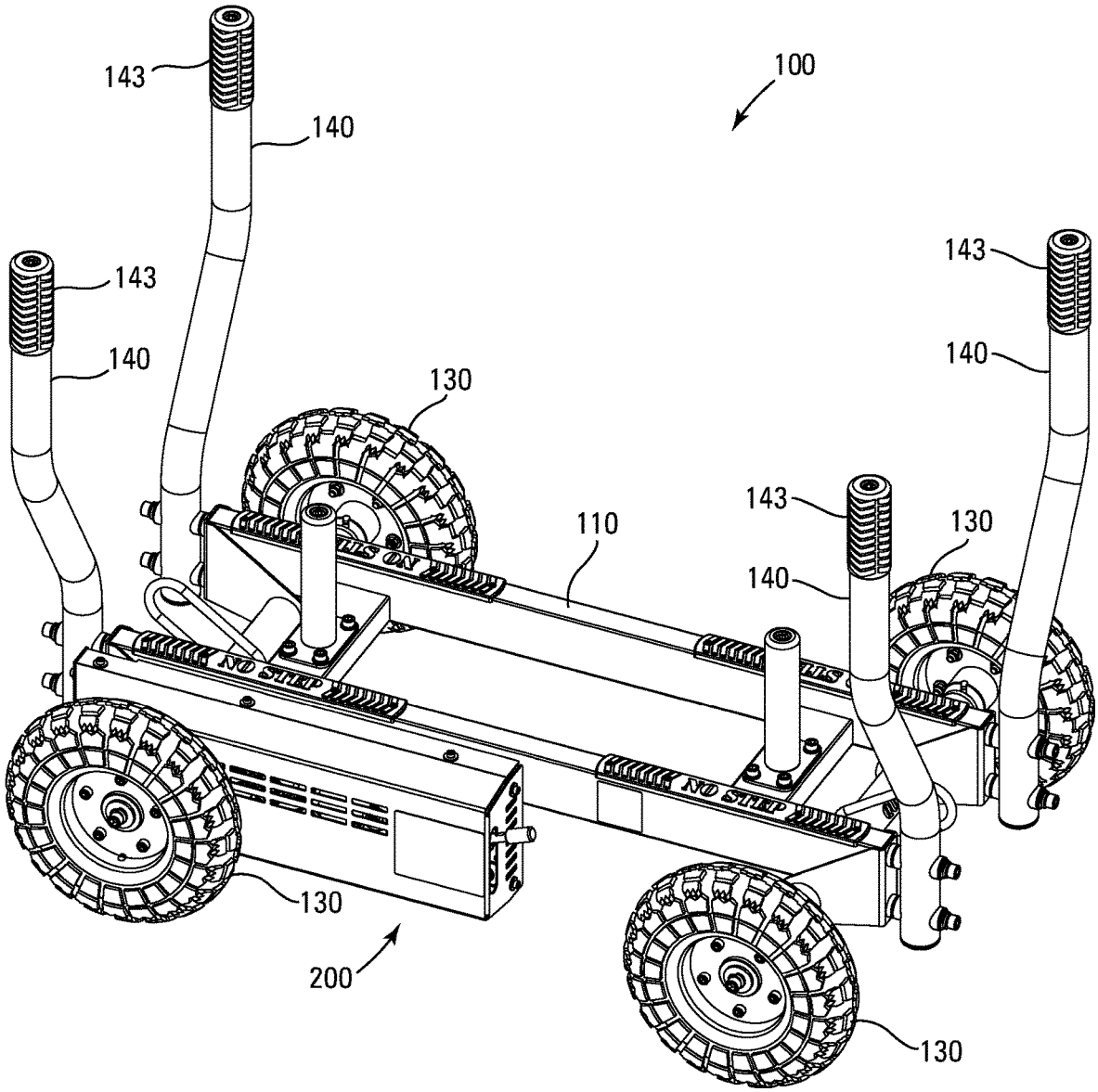
FIG. 1 is a perspective view of one embodiment of the invention.
Figure 1:
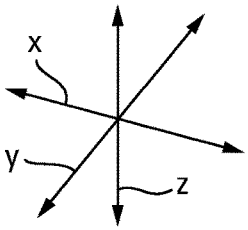
Figure 2:
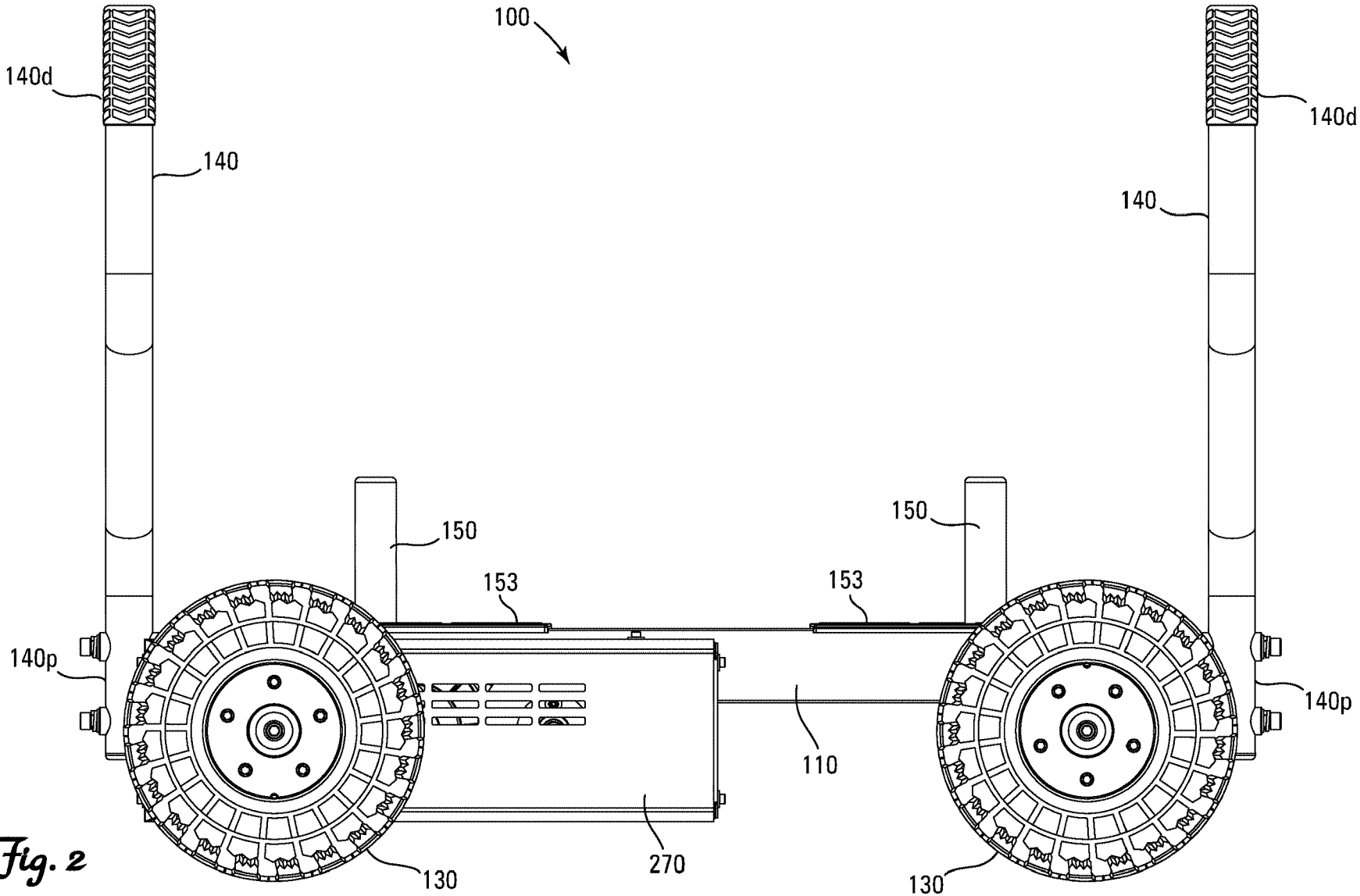
FIG. 2 is a side view of the invention depicted in FIG. 1.
Figure 3:
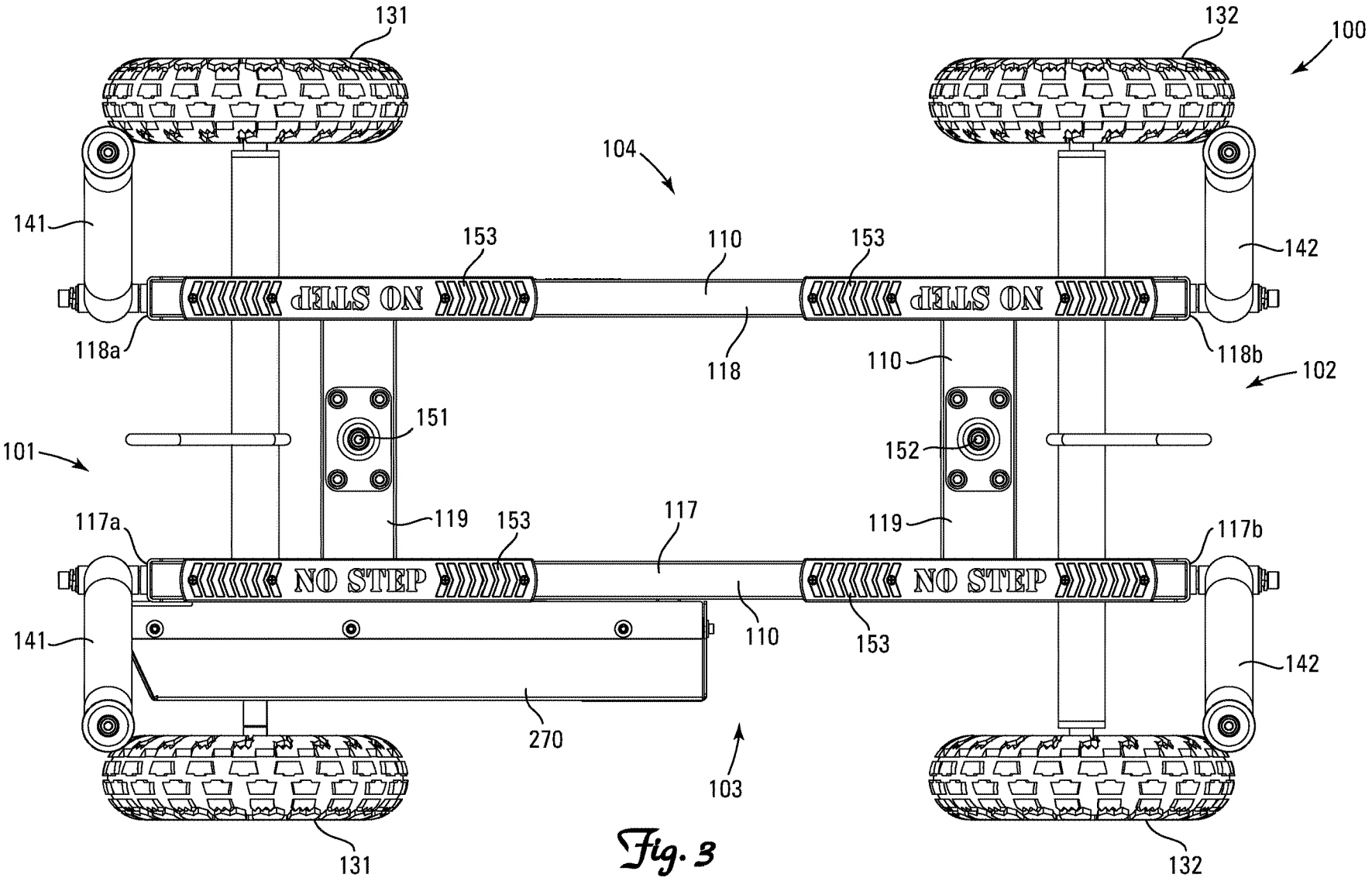
FIG. 3 is a top view of the invention depicted in FIG. 1.
Figure 4:
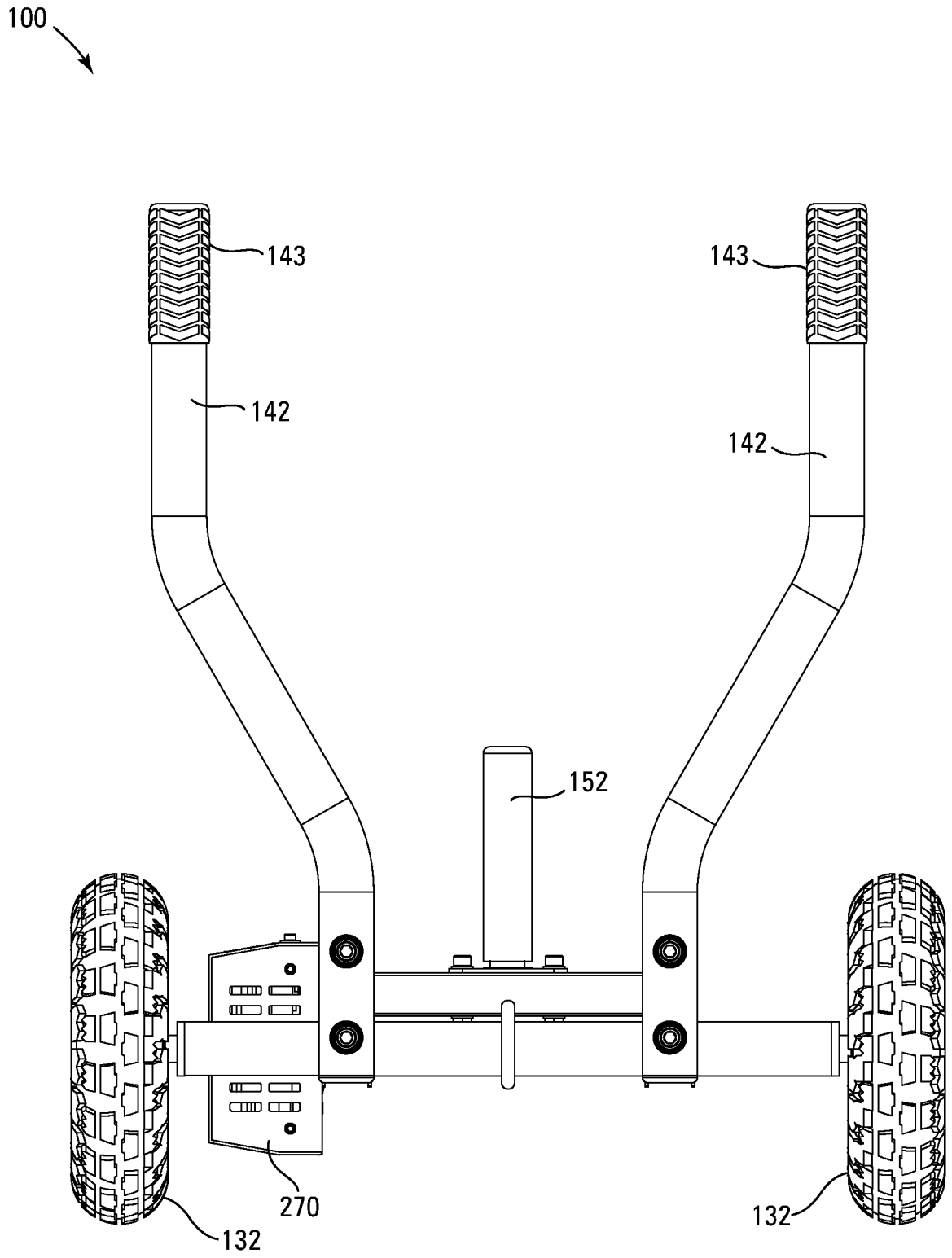
FIG. 4 is an end view of the invention depicted in FIG. 1.
Figure 5:
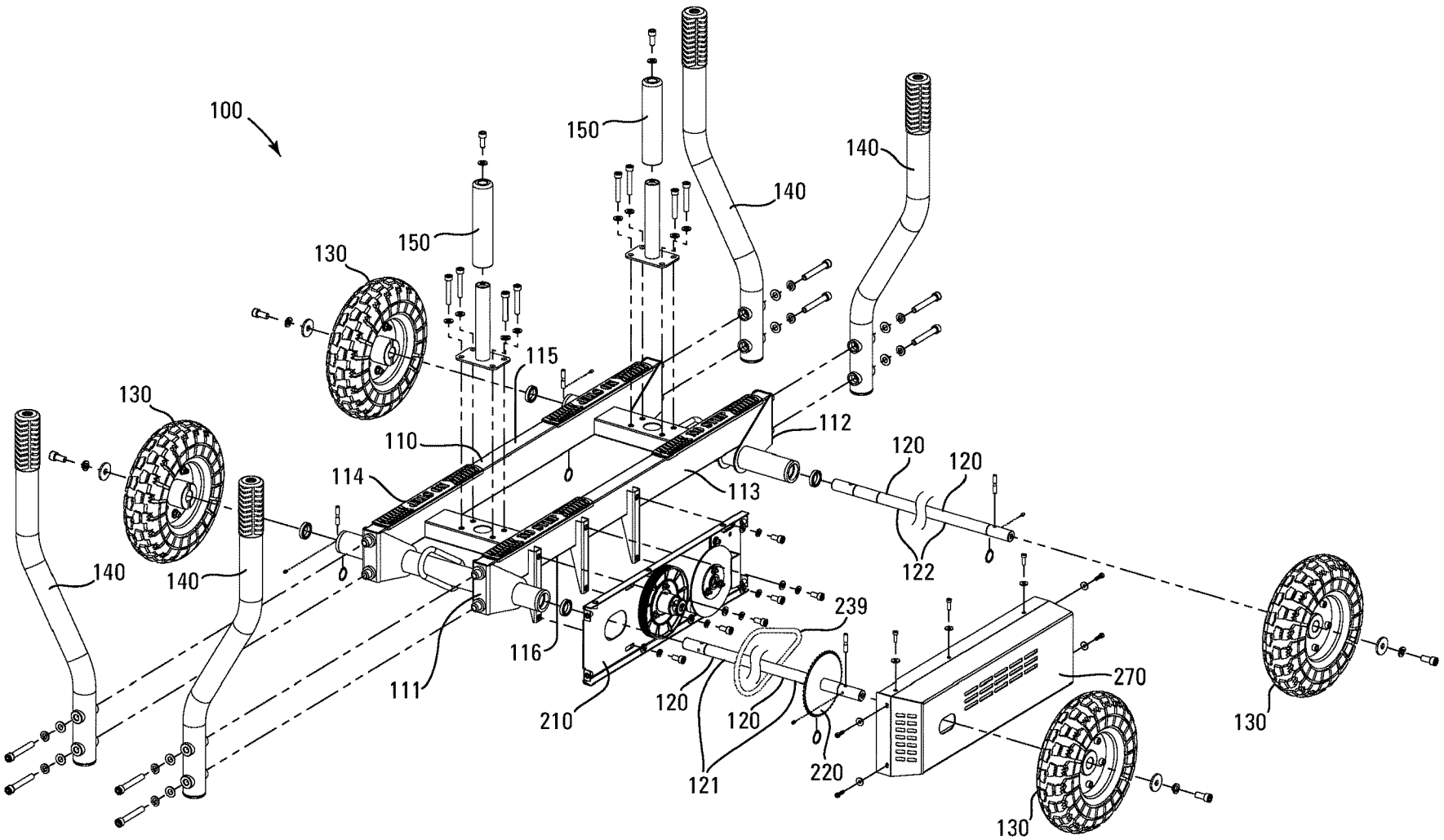
FIG. 5 is an exploded perspective view of the invention depicted in FIG. 1.

As utilized herein, including the claims, the term "substantially linear" means a maximum orthogonal deviation from a straight line connecting the starting point and ending point of less than 10%. By way of example, movement of the wheeled weight sled of the present invention along a warped path of travel from a starting point to an end point separated by a straight line distance of 20 meters with a maximum side-to-side orthogonal offset from that straight line segment of less than 2 meters is "substantially linear".

As utilized herein, including the claims, the term "neutral resistance" means resistance at or near zero, whereby the wheeled exercise sled of the present invention is rendered suitable for use as a wheeled transport wagon when the braking mechanism is set to neutral.

Nomenclature Table

| REF. NO. | NAME |
|---|---|
| 100 | Weight Training Sled |
| 101 | First End of Weight Training Sled |
| 102 | Second End of Weight Training Sled |
| 103 | First Side of Weight Training Sled |
| 104 | Second Side of Weight Training Sled |
| 110 | Chassis |
| 111 | First End of Chassis |
| 112 | Second End of Chassis |
| 113 | First Side of Chassis |
| 114 | Second Side of Chassis |
| 115 | Top of Chassis |
| 116 | Bottom of Chassis |
| 117 | First Side Rail of Chassis |
| 117a | First End of First Side Rail |
| 117b | Second End of First Side Rail |
| 118 | Second Side Rail of Chassis |
| 118a | First End of Second Side Rail |
| 118b | Second End of Second Side Rail |
| 119 | Cross Beams Interconnecting Side Rails |
| 120 | Axles |
| 121 | First Axle |
| 122 | Second Axle |
| 130 | Wheels |
| 131 | First Pair of Wheels |
| 132 | Second Pair of Wheels |
| 140 | Push Handles |
| 140d | Distal End of Push Handles |
| 140p | Proximal End of Push Handles |
| 141 | First Pair of Push Handles |
| 142 | Second Pair of Push Handles |
| 143 | Grips on Each Push Handle |
| 145 | Cross Member |
| $148_1$ | First Length of the Push Handles |
| $148_2$ | Second Length of the Push Handles |
| 149 | Lateral Gap Between Paired Push Handles |
| $149_1$ | Largest Gap Between Paired Push Handles Within the First Length |
| $149_2$ | Smallest Gap Between Paired Push Handles Within the Second Length |
| 150 | Weight Plate Horns |
| 151 | First Weight Plate Horn |
| 152 | Second Weight Plate Horn |
| 153 | Rubber Bumpers |

-continued

| REF. NO. | NAME |
|---|---|
| 160 | Tow Hook |
| 200 | Braking Mechanism |
| 201 | First Braking Mechanism |
| 202 | Second Braking Mechanism |
| 210 | Mounting Plate for Braking Mechanism |
| 211 | Axle Passage Orifice |
| 212 | Pulley Assembly Mounting Post |
| 213 | Eddy Disk Assembly Mounting Post |
| 214 | Tensioning System Adjustment Slot |
| 215 | Magnetic Stator Position Adjustment Slot |
| 220 | Drive Sprocket |
| 230 | Pulley Assembly |
| 231 | Internal Hub |
| 232 | Sprocket Mount |
| 233 | Driven Sprocket |
| 234 | Pulley |
| 239 | Drive Chain |
| 240 | Eddy Disk Assembly |
| 241 | Disk Mount |
| 241' | Shaft of Disk Mount |
| 241" | Mounting Plate of Disk Mount |
| 242 | Eddy Disk |
| 249 | Drive Belt |
| 250 | Drive Belt Tensioning Assembly |
| 260 | Magnetic Stator Assembly |
| 261 | Magnets |
| 265 | Magnetic Stator Position Adjustment Lever |
| 270 | Shroud for Braking Mechanism |
| 530 | Runners |
| α | Inward Angle from Vertical |
| β | Downward Angle from Vertical |
| x | Longitudinal Direction |
| y | Lateral Direction |
| z | Transverse Direction |

Construction

With reference to the illustrative drawings, the invention is directed to a weight training sled 100 (hereinafter "sled") characterized by one or more of (A) rotatable wheels 130 in contact with ground, (B) curvilinear push handles 140 configured and arranged to (i) provide a comfortable and natural spacing of hand grips 143 on the push handles 140, (ii) provide a comfortable and ergonomic inward a angling of the hand grips 143 on the push handles 140 relative to vertical, and (iii) provide a downward β angling of the hand grips 143 on the push handles 140 in order to limit the amount of upward force vector created when a user is pushing the sled 100 and preferably configured and arranged to generate a downward force vector so as to prevent or limit lifting of the work end of the sled 100 off the ground, and (C) a tow hook 160 mounted on the sled 100 to provide a clearance of at least 30 cm to limit the amount of upward force vector created when a user pulls upon a tow rope (not shown) attached to the sled 100 at the tow hook 160 and preferably configured and arranged to generate a downward force vector so as to prevent or limit lifting of the towed end of the sled 100 off the ground.

Wheeled Sled

The wheeled sled 100 includes a chassis 110, at least two fixed-directional wheels 130, a pair of push handles 140, and at least one braking mechanism 200. The wheeled sled 100 preferably includes (i) four fixed-directional wheels 130, mounted upon a pair of axles 120 so as to form a tandem axle four wheeled weight training sled 100, and (ii) at least one and preferably two weight plate horns 150.

The wheeled sled 100 has longitudinally x spaced first and second ends 101 and 102, and laterally y spaced first and second sides 103 and 104.

A preferred chassis 110, depicted in FIGS. 1-5, is a metal structure having first and second longitudinally x elongated and laterally y spaced side rails 117, 118 rigidly interconnected by cross-beams 119, defining a chassis 110 with first and second longitudinal ends 111 and 112, first and second lateral sides 113 and 114, and a transverse top 115 and bottom 116.

The wheels 130 are fixed-directional wheels 130 rotatably mounted to the chassis 110 for supporting the bottom 116 of the chassis 110 a distance above a surface (hereinafter referenced as "clearance"). The fixed-directional and longitudinal spacing of at least two of the wheels 130 constrains the chassis 110 to reciprocating travel upon a surface along a substantially linear longitudinal x path.

When two wheels 130 are employed they are preferably longitudinally x aligned in the midsagittal plane of the sled 100. When three wheels 130 are employed they are preferably spaced at the corners of an isosceles triangle with two of the wheels 130 laterally y aligned proximate one end 101 of the sled 100 and the third centrally positioned proximate the other end 102 of the sled 100. When four wheels 130 are employed, as depicted in FIGS. 1-5, the wheels 130 are mounted in laterally y spaced pairs 131 and 132 upon each of two laterally y extending axles 121 and 122 respectively, with the axles 121 and 122 mounted proximate each longitudinal end 101 and 102 of the sled 100 respectively, and the wheels 130 in each pair of wheels 131 and 132 mounted proximate opposite sides 103 and 104 of the sled 100. The four wheel embodiment is generally preferred as it provides enhanced stability, enhanced linear travel along the longitudinal x path, and facilitates exercise in both directions along the linear path of travel. Alternatively, the four wheel embodiment may employ a pair of longitudinally x aligned and laterally y centered wheels 130 proximate the longitudinal ends 101 and 102 of the sled 100, with a vertically z raised or vertically z aligned outrigger wheel 130 extending from each side 103 and 104 of the sled 100.

The wheels 130 are preferably pneumatic wheels 130 with good traction in order to limit undesired sliding of the wheels 130 across the floor during exercise as opposed to desired rotation of the wheels 130.

At least one pair of laterally y spaced push handles 140 are attached proximate a proximal end 140*p* of the push handles 140, proximate one end 111 or 112 of the chassis 110 for being gripped by a user to push the sled 100. As depicted in FIGS. 1-5, the sled 100 preferably includes two pair of push handles 141 and 142, with a first pair of push handles 141 secured to the first ends 117*a* and 118*a* of the chassis side rails 117 and 118, and a second pair of push handles 142 secured to the second ends 117*b* and 118*b* of the chassis side rails 117 and 118. This allows a user to exercise by pushing the sled in either direction along the longitudinal x path of travel.

One or more weight plate horns 150 can be provided on the chassis 110 for mounting weight plates (not shown) onto the top 115 of the chassis 110 in order to increase exercise resistance offered by the sled 100 and, more importantly, counteract any upward lifting force vector exerted by a user that would tend to lift an end of the sled 100 and thereby lift the wheel(s) 130 closest to the user off the floor. As depicted in FIGS. 1-5, the preferred embodiment has first and second weight plate horns 151 and 152 positioned along the midsaggital plane of the sled 100, each secured to a cross beam 119 proximate each end 111 and 112 of the chassis 110. Rubber bumpers 153 can be provided atop the chassis 115 proximate each horn 151 and 152 for cushioning and protecting the chassis 110 when weight plates are added to or removed from the horns 150.

Referring generally to FIGS. 1-5, a braking mechanism 200 is attached to the chassis 110 and in communication with at least one of the wheels 130, preferably in communication with a pair of wheels 130 mounted on the same axle 120, for exerting a bidirectional controlled variable resistive force against rotation of the wheel(s) 130 along the longitudinal x path of travel. Separate braking mechanisms 201 and 202 can be provided for each wheel 130 or each axle 120, and is preferred when the sled 100 is designed with push handles 140 at each end 101 and 102 for bidirectional resistive travel. Many types of resistance devices are known such as braking motors, generators, brushless generators, eddy current systems, magnetic systems, alternators, tightenable belts, friction rollers, fluid brakes, etc., any of which could be effectively utilized in the present invention. A braking mechanism capable of providing progressive resistance based upon acceleration or speed of travel is generally preferred.

Figure 6:
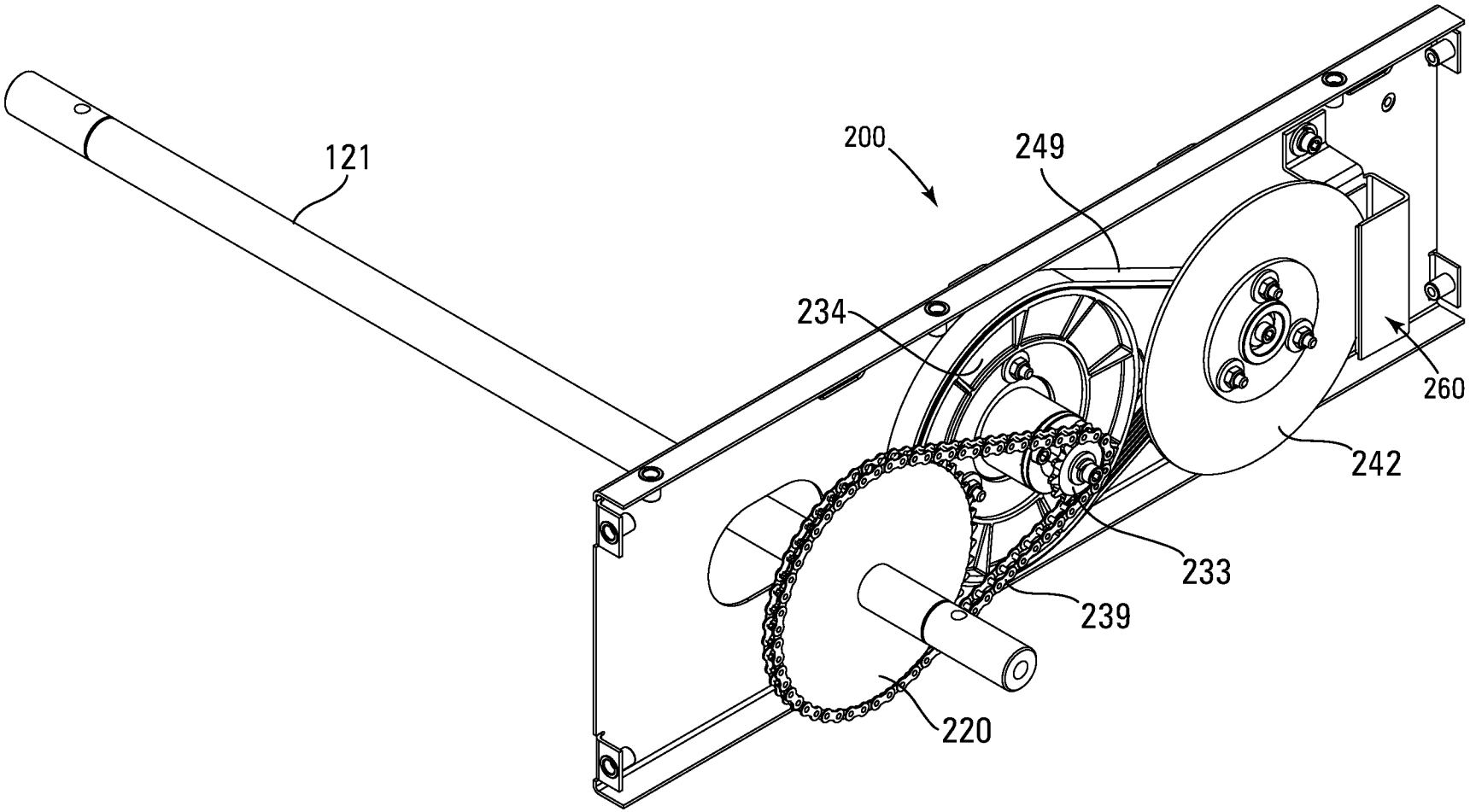
FIG. 6 is an enlarged perspective view of the braking mechanism on the invention depicted in FIG. 1.
Figure 6A:
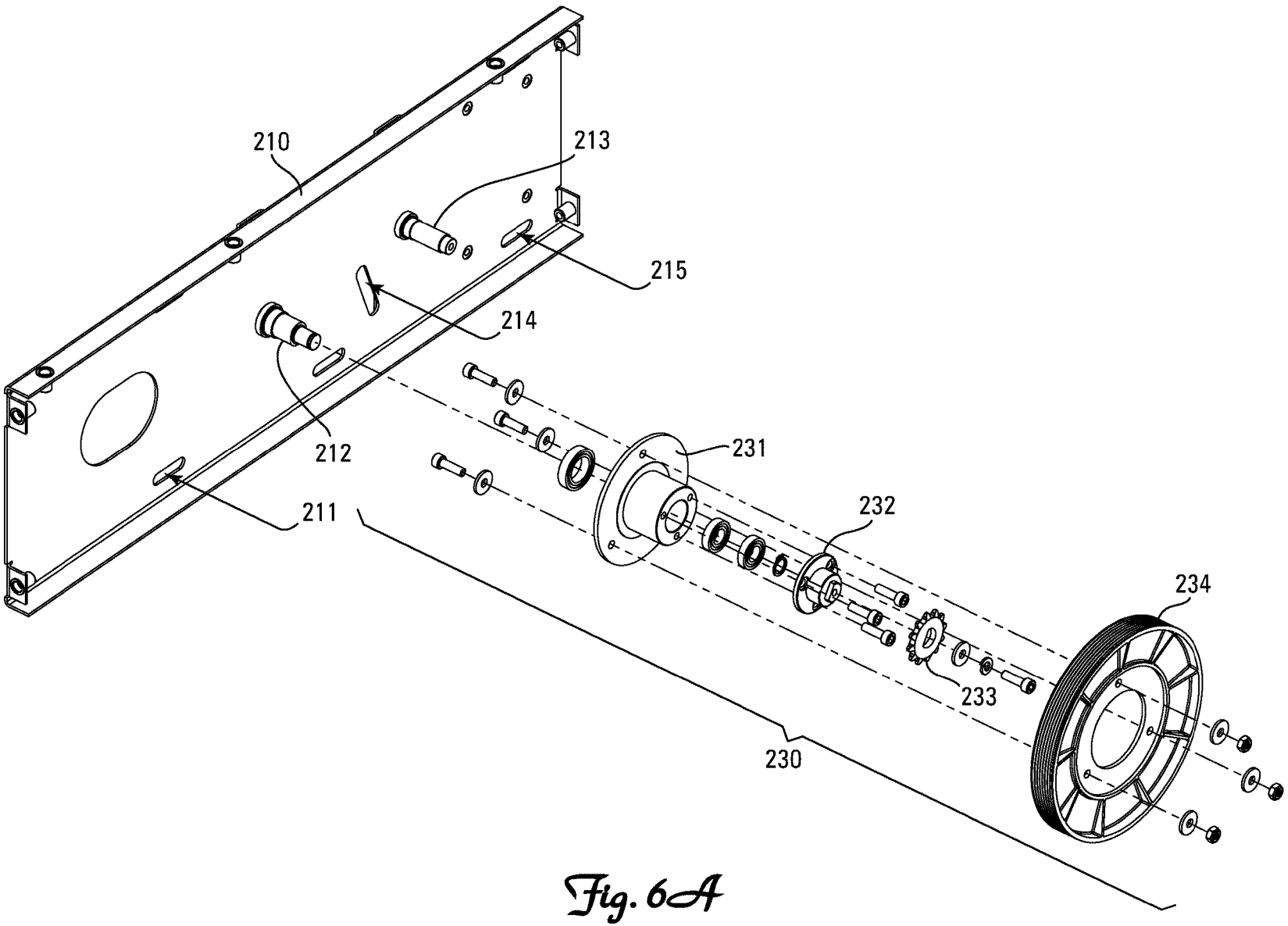
FIG. 6A is an exploded perspective view of the pulley assembly portion of the braking mechanism depicted in FIG. 6.
Figure 6B:
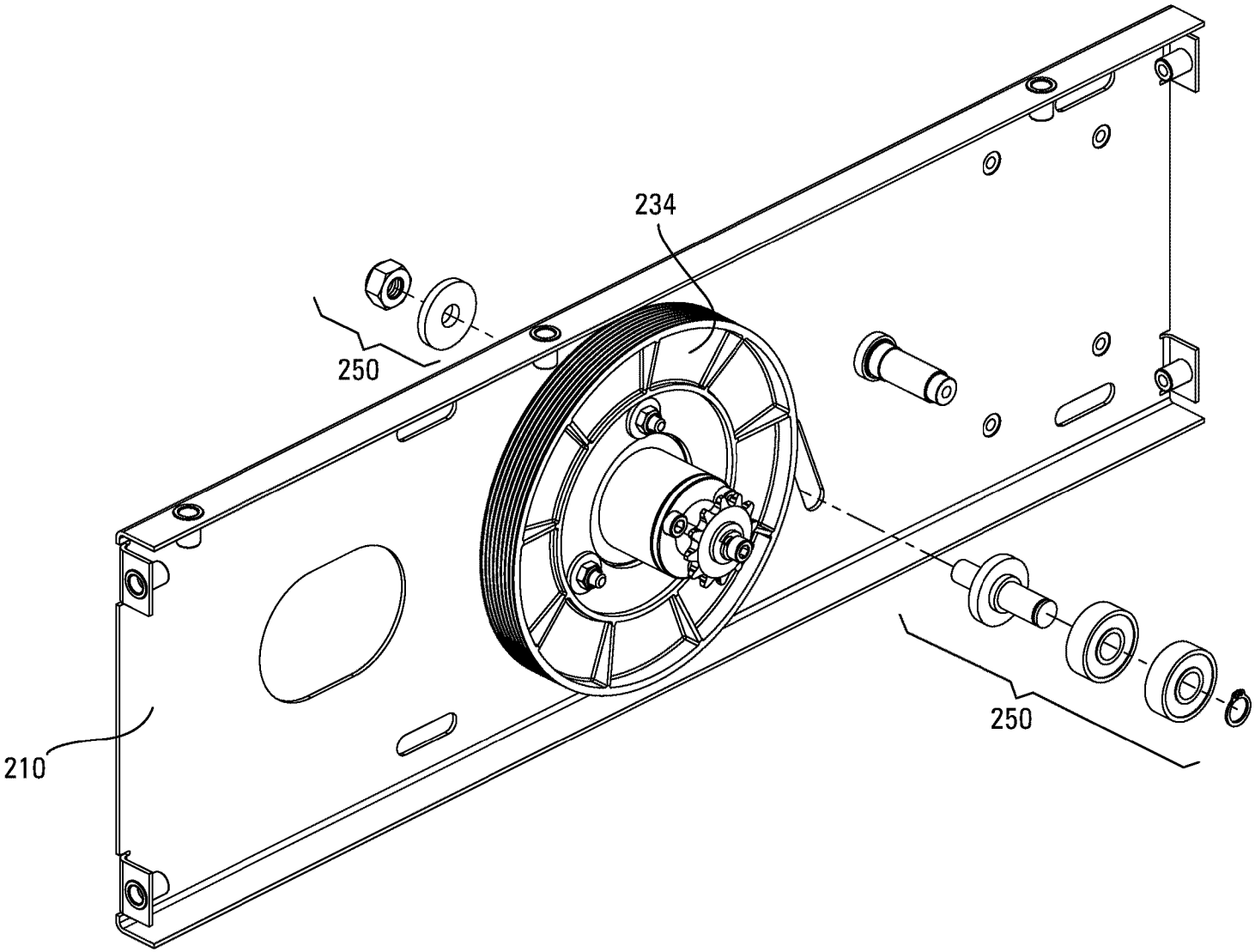
FIG. 6B is an exploded perspective view of the tensioning assembly portion of the braking mechanism depicted in FIG. 6.
Figure 6C:
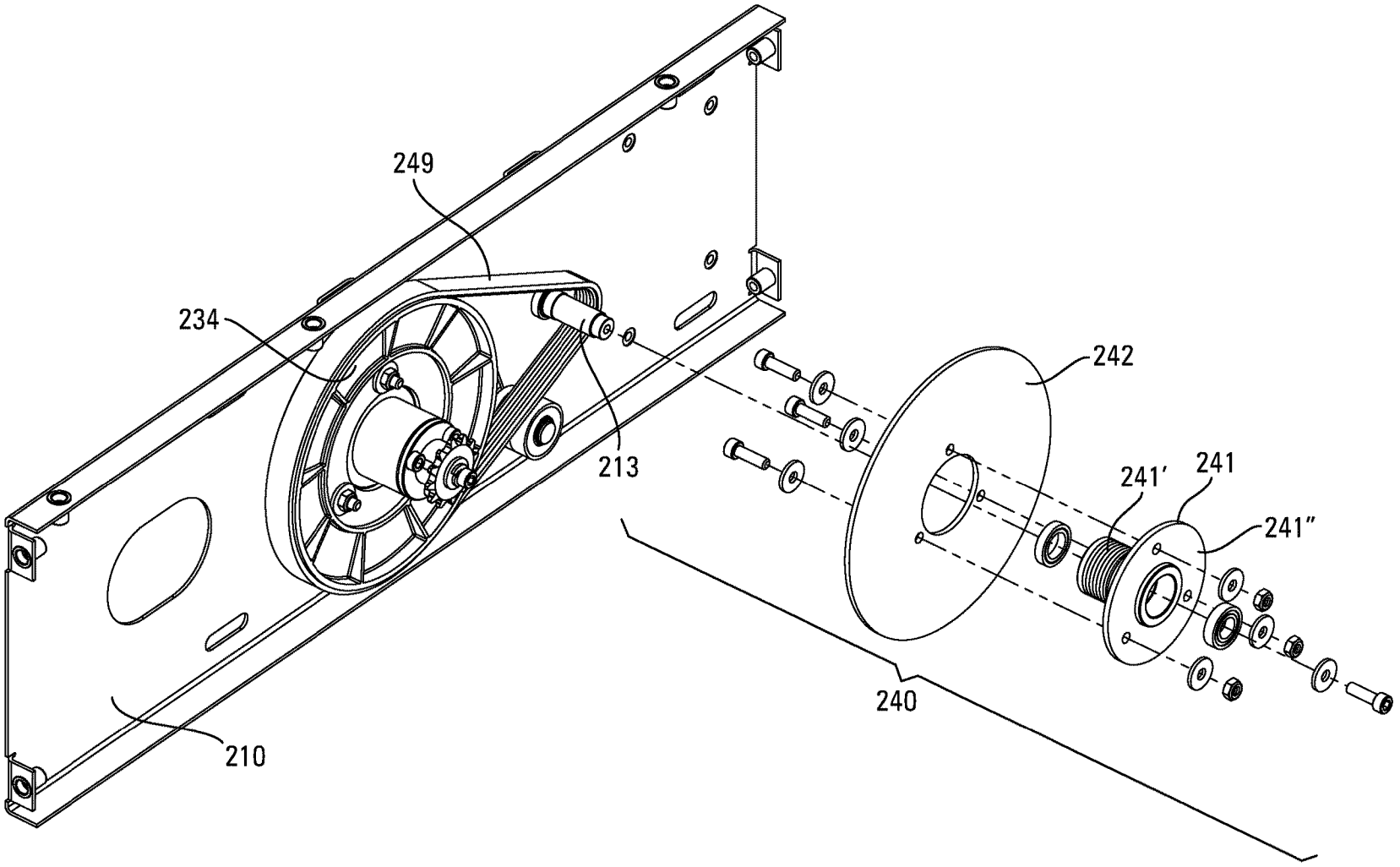
FIG. 6C is an exploded perspective view of the eddy disk assembly portion of the braking mechanism depicted in FIG. 6.
Figure 6D:
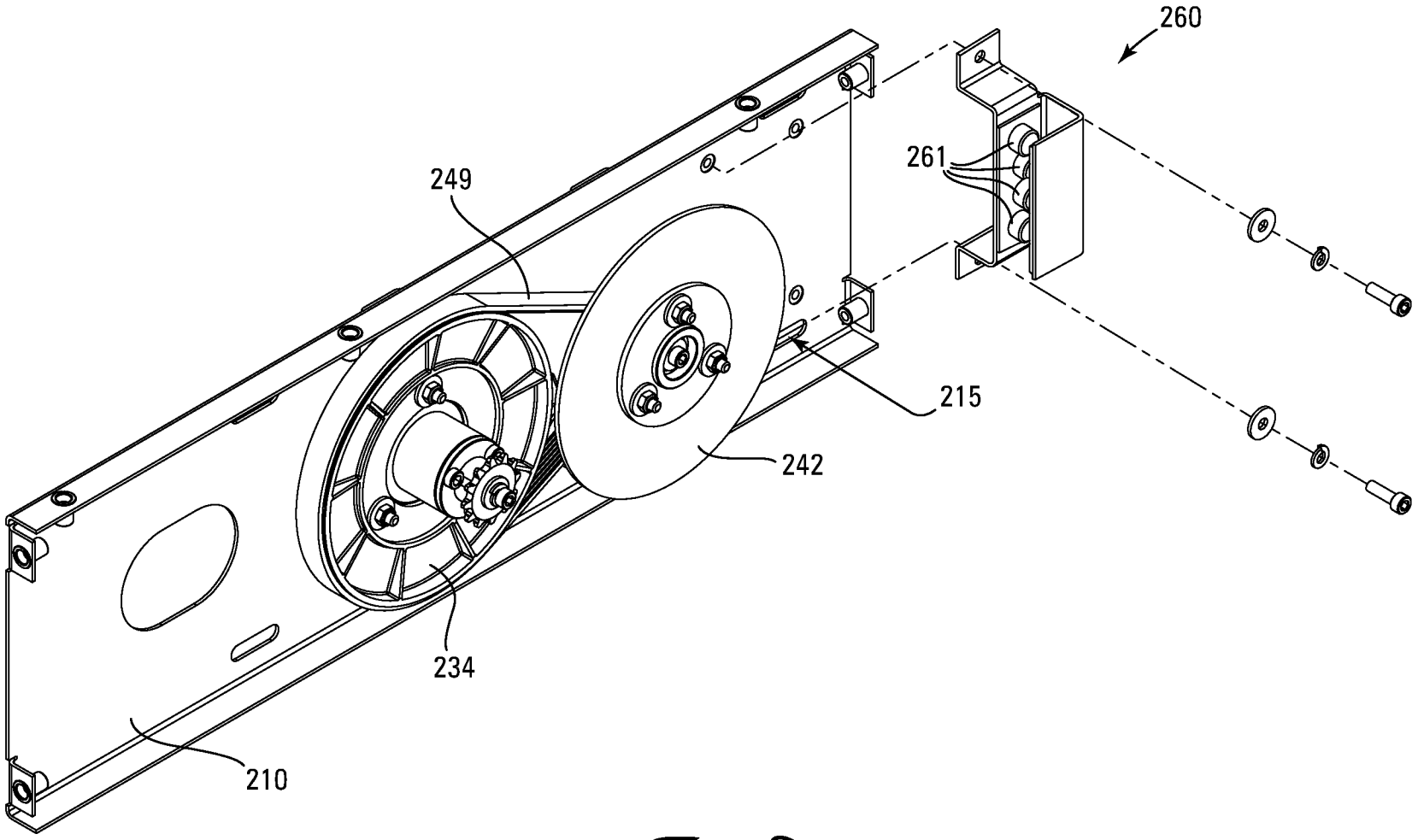
FIG. 6D is an exploded perspective view of the magnetic stator assembly portion of the braking mechanism depicted in FIG. 6.
Figure 7:
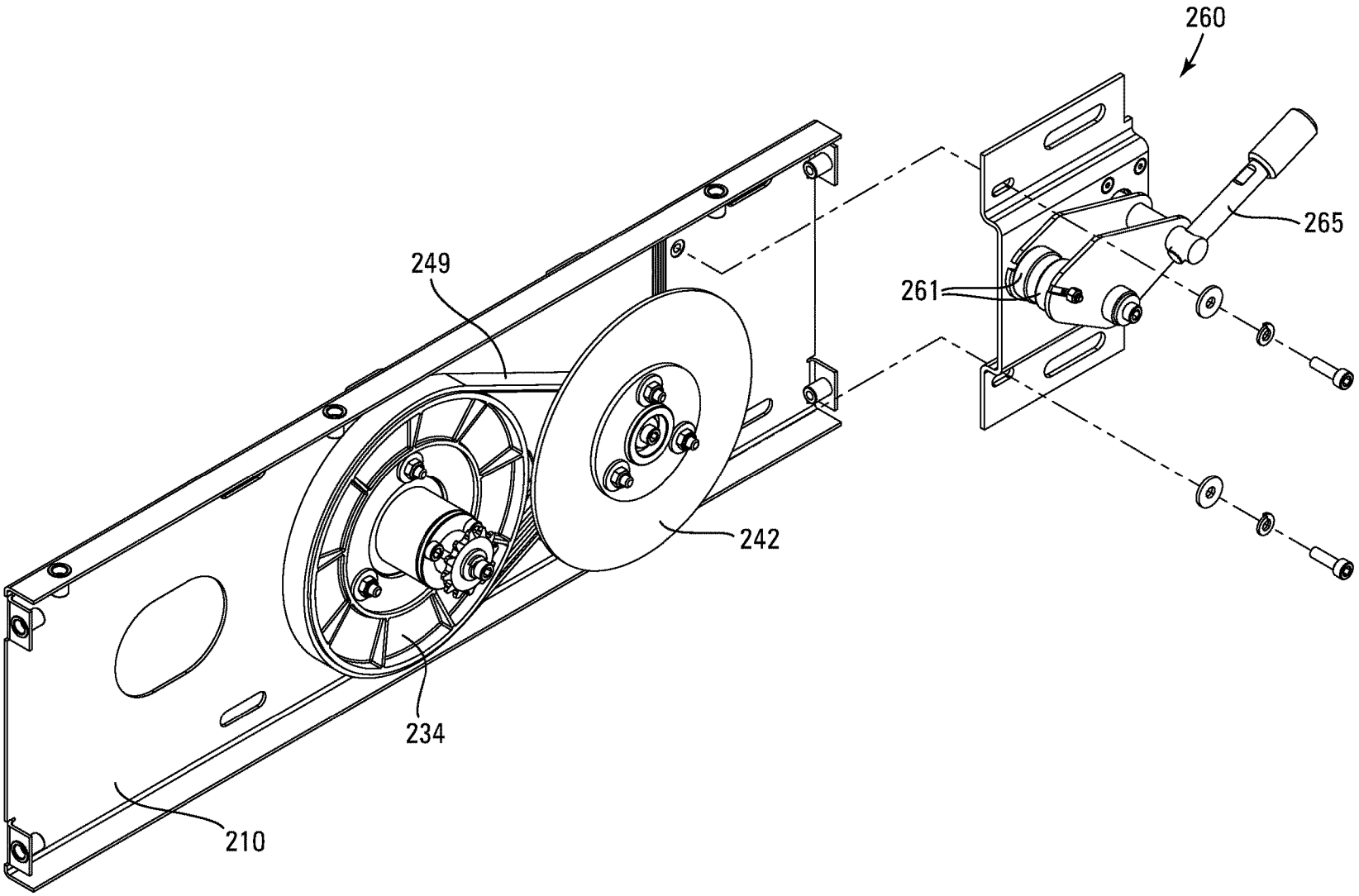
FIG. 7 is an exploded perspective view of another embodiment of a magnetic stator assembly useful in the braking mechanism depicted in FIG. 6.

In further detail, and in reference to FIG. 6, the preferred braking mechanism 200, is an eddy current brake 200 mounted to a first side rail 117 of the chassis 110 for exerting resistance to rotation of a first axle 121. The eddy current brake 200, depicted fully assembled in FIG. 6 and depicted component-by-component in FIGS. 6A-6D, includes (i) a mounting plate 210 rigidly attached to the chassis 110 (FIG. 5), (ii) a drive sprocket 220 rotatably with and secured to a portion of the first axle 121 extending through an orifice 211 in the mounting plate 210 (FIG. 6), (iii) a pulley assembly 230 (FIG. 6A) with a pulley 234 and driven sprocket 233 rotatably mounted via an internal hub 231 and a sprocket mount 232 onto a first mounting post 212 projecting from the mounting plate 210 in rotatable driven communication with the drive sprocket 220 via a drive chain 239 (FIG. 6), (iv) an eddy disk assembly 240 comprised of an eddy disk 242 rotatably mounted via a disk mount 241 having a shaft 241' and mounting plate 241" onto a second mounting post 213 projecting from the mounting plate 210 in rotatable driven communication with the pulley assembly 230 via a drive belt 249 (FIG. 6C), (v) a drive belt tensioning assembly 250 secured within an adjustment slot 214 in the mounting plate 210 for adjustably tensioning the drive belt 249 (FIG. 6B), and (vi) a magnetic stator assembly 260 secured to the mounting plate 210 for manual (as shown) or automatic (not shown) repositioning of the magnets 261 relative to the eddy disk 242 of the eddy disk assembly 240 via an adjustment slot 215 in the mounting plate 210 as depicted in FIG. 6D or a multi-stop lever 265 as depicted in FIG. 7, to increase or decrease resistance as desired.

In a preferred embodiment the braking mechanism 200 is adjustable into a neutral resistance setting, whereby the sled 100 is effectively converted from an exercise sled to a transport wagon. The neutral setting facilitates movement of the sled 100 from one location to another, such as transport back and forth between a storage location and a use location. When in the neutral resistance setting, and equipped with a removable basket, the sled 100 is effective for use in transporting items such as additional exercise equipment to be used in an exercise workout, from one location to another. The neutral setting preferably applies some modest resistance to rotation of the wheels which does not appreciably interfere with transport of the sled 100 but is effective for preventing or at least slowing down gravity induced movement of the sled 100.

A protective shroud 270 may be provided over the components of each braking mechanism 201 and 202.

Curvilinear Push Handles

Referring to FIGS. 8-11, each pair of laterally y spaced push handles 140 are preferably curvilinear so as to provide (A) grips 143 proximate the distal ends 140*d* of the push handles 140 that angle inward a towards one another and downward β towards the chassis 110, and/or (B) a laterally y extending gap 149 between axial centers of paired push handles 140 whose lateral y width increases along a first length $\mathbf{148}_1$ of the paired push handles 140 closer to the chassis 110, and decreases along a second length $\mathbf{148}_2$ of the paired push handles 140 further from the chassis 110, defining a largest gap $\mathbf{149}_1$ between the paired push handles 140 within the first length $\mathbf{148}_1$ and a smallest gap $\mathbf{149}_2$ between the paired push handles 140 within the second length $\mathbf{148}_2$.

Inward α angling of the grips 143 provides a more natural ergonomic rotational gripping position, while downward β angling of the grips 143 redirects at least some of the vertical force vector created when a user is pushing the sled 100 from an upwardly directed force vector to a downwardly directed force vector, thereby preventing or at least limiting lifting of the work end of the sled 100 off the ground.

The grips 143 each preferably have an inward angle α of at least 10°, preferably between 15° and 30°, and a downward angle β of at least 10°, preferably between 15° and 30°.

The curvilinear angling of each paired set of push handles 140 preferably provides a change of at least 20% in the lateral y width of the gap 149 from the smallest width $\mathbf{149}_2$ to the largest width $\mathbf{149}_1$ (e.g., for a smallest width $\mathbf{149}_2$ of 20 cm the largest width $\mathbf{149}_1$ would be at least 24 cm). This change in lateral y width of the gap 149 is preferably between 20% and 40%.

Such curvilinear push handles 140 are suitable for use with most types of exercise sled 100, including typical friction sleds that ride on runners 530 and wheeled sleds described herein.

Elevated Tow Rope Hook

Figure 9:
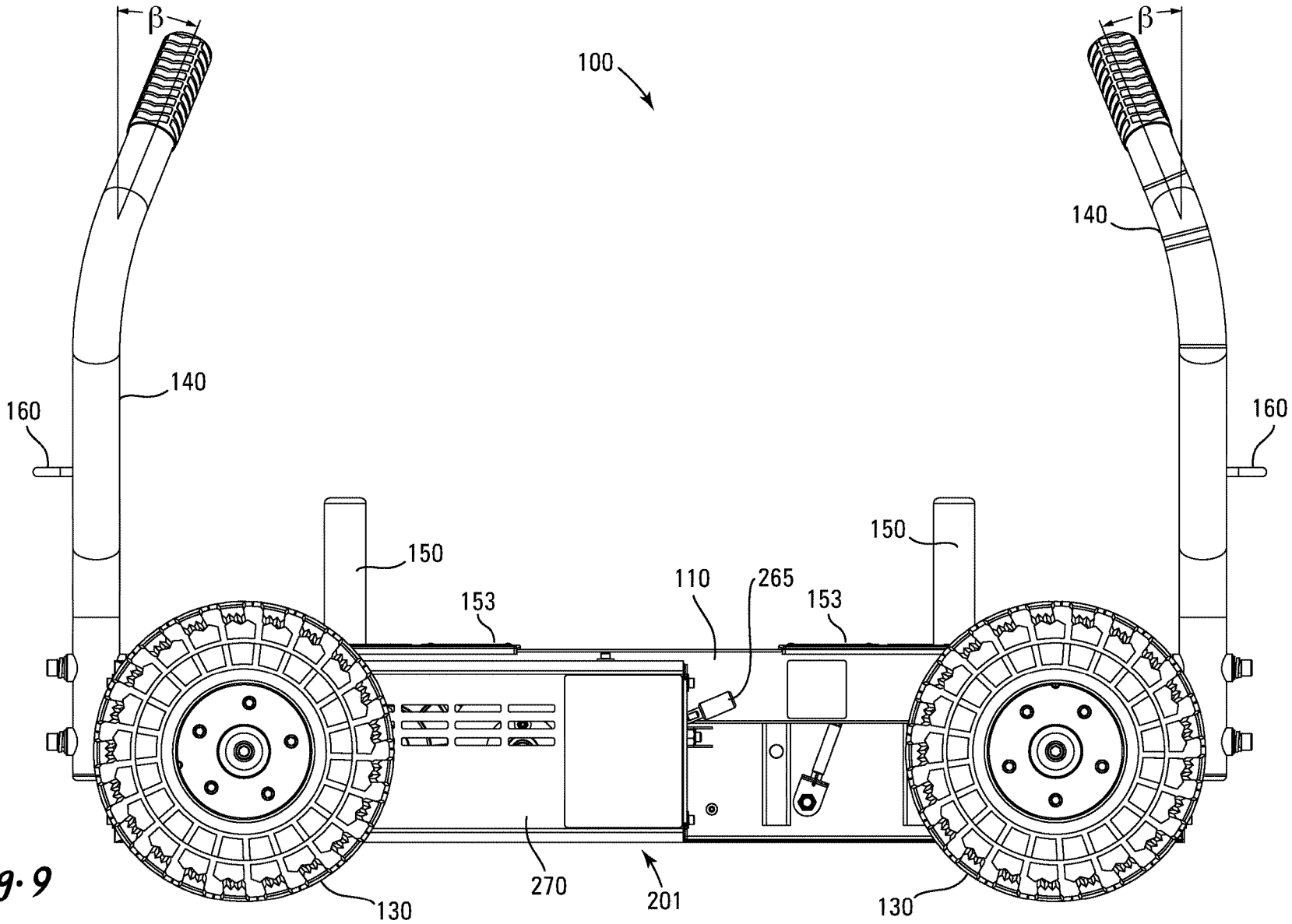
FIG. 9 is a side view of the invention depicted in FIG. 8.
Figure 10:
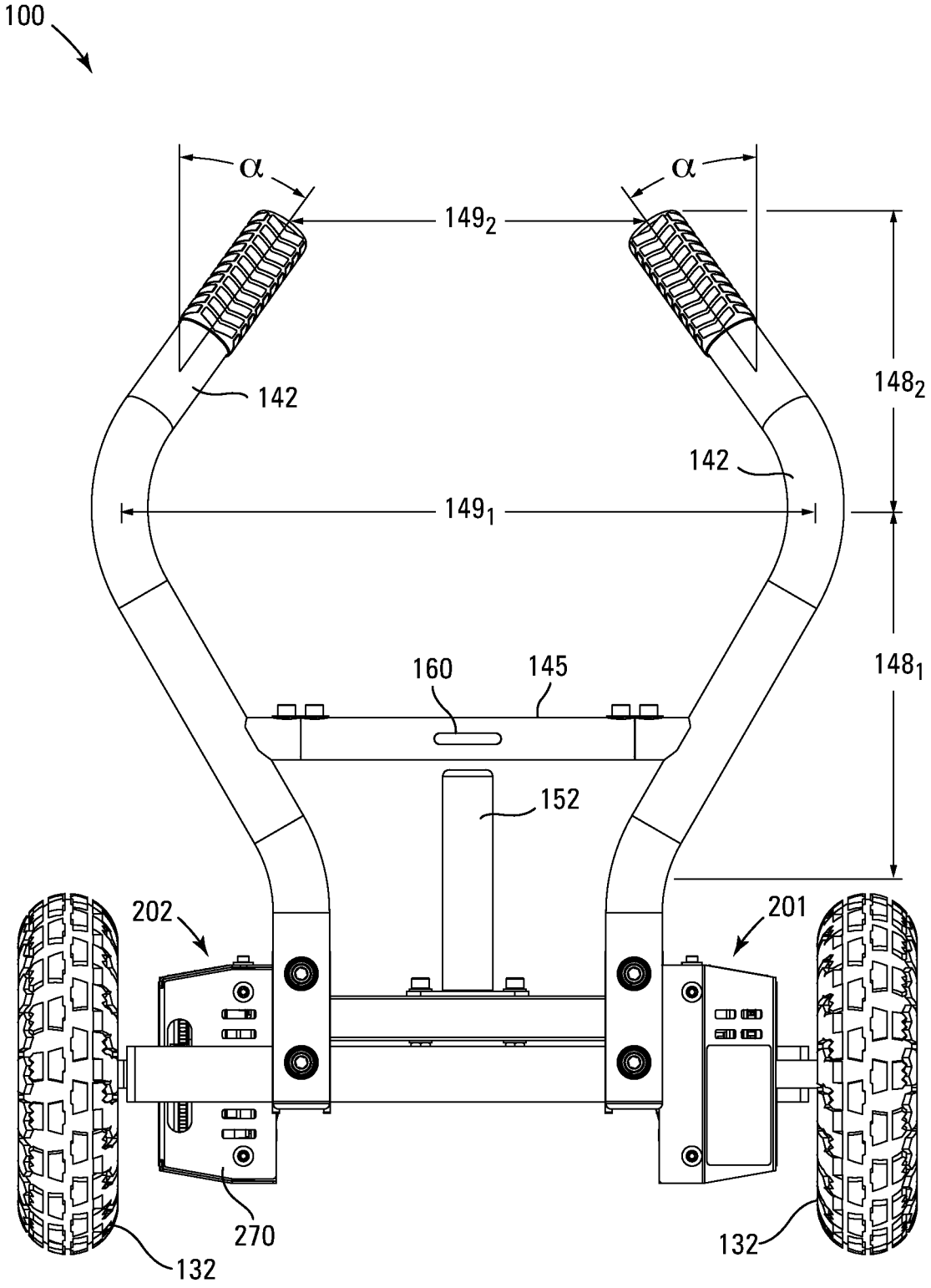
FIG. 10 is an end view of the invention depicted in FIG. 8.
Figure 11:
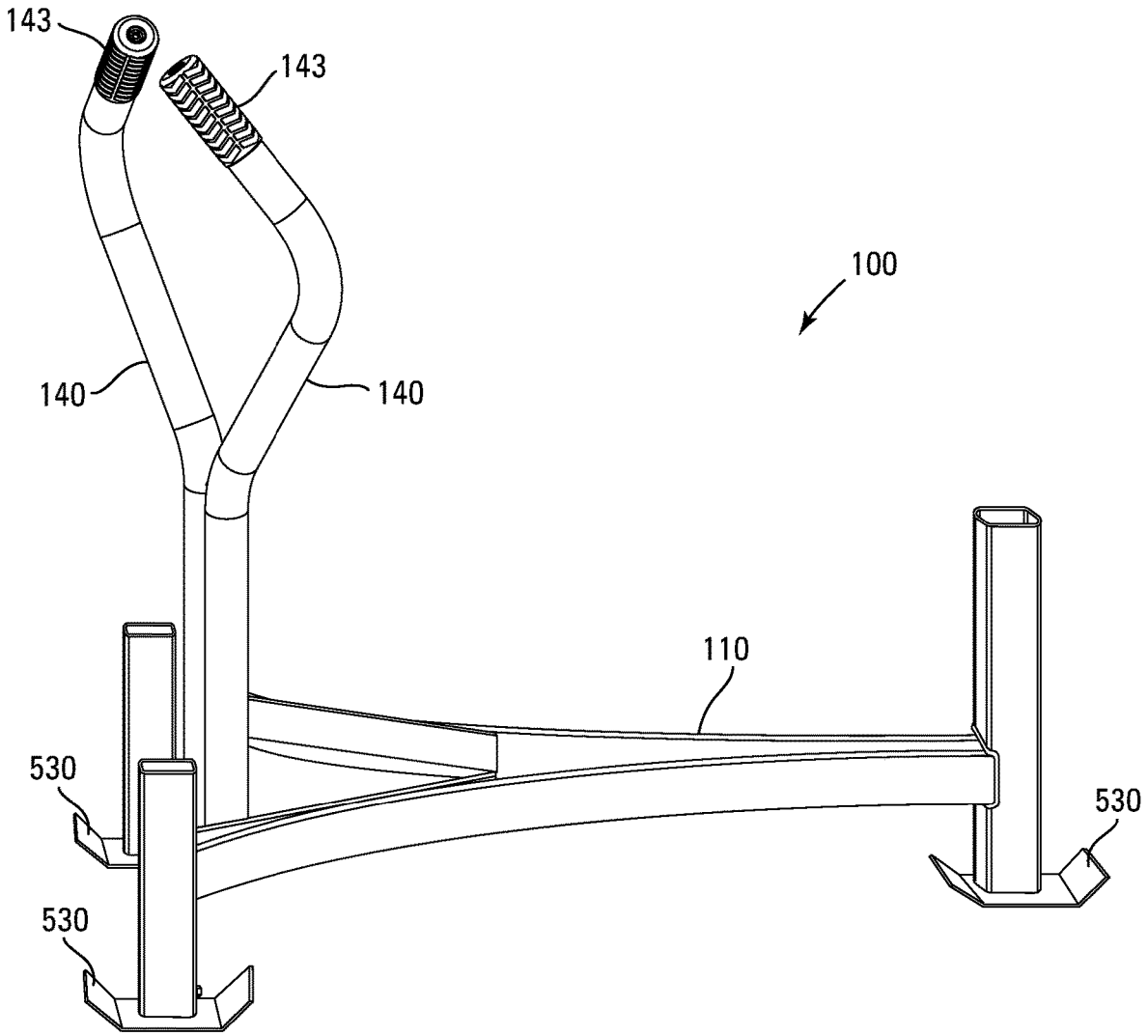
FIG. 11 is a perspective view of yet another embodiment of the invention.

Referring to FIGS. 8-10, each pair 141 and 142 of laterally y spaced push handles 140 can be interconnected by a cross member 145, located a longitudinal x distance above the chassis 110. This cross member 145 provides both stabilization of the paired push handles 140 and an elevated position for attachment of a tow rope (not shown) to the sled 100. A tow hook 160 preferably extends longitudinally x outward from the lateral y center of each cross member 145 to facilitate temporary attachment of a tow rope (not shown). The cross member 145, particularly when positioned at the very distal ends 140*d* of the paired push handles 140, can be gripped by a user pushing the sled 100 as an alternative gripping position.

The cross member 145, and thereby the tow hook 160, is preferably located so as to provide a clearance of at least 30 cm between the tow hook 160 and ground. Such elevated positioning of the tow hook 160 serves to limit the amount of upward force vector created when a user pulls upon a tow rope (not shown) attached to the sled 100 at the tow hook 160, thereby limiting and potentially eliminating lifting of the towed end of the sled 100 off the ground.

Dimensions

Various acceptable, preferred and most preferred dimensions having some significance to the value and/or performance of the sled 100 are provided below.

| Dimension | Acceptable (cm) | Preferred (cm) | Most Preferred (cm) |
|---|---|---|---|
| | Chassis | | |
| Longitudinal Length of Chassis | 60-150 | >100 | 100-140 |
| Lateral Width of Chassis | 30-100 | 40-80 | 50-60 |
| Transverse Height of Chassis | 3-30 | 5-20 | 10-20 |
| Clearance | >2 | 5-20 | 10-15 |
| | Wheels | | |
| Wheelbase | 60-100 | >80 | 80-100 |
| Track | 40-100 | 60-100 | 80-100 |
| | Push Handles | | |
| Height relative to Floor | 40-120 | 50-100 | 60-100 |
| Lateral Spacing at Top End | 70-120% of Track | 80-100% of Track | 80-90% of Track |

Use

The sled 100 can be conveniently and safely used in a confined space as small as 1.2 meters wide and 5 meters long, by (i) setting the braking mechanism(s) 200 to the desired resistance, (ii) standing at the first end 101 of the sled 100, (iii) leaning forward and gripping the first pair of push handles 141, (iv) pushing the sled 100 in a first longitudinal x direction along a longitudinal path, (v) walking around the sled 100 to the second end 102 of the sled 100, (vi) leaning forward and gripping the second pair of push handles 142, (vii) pushing the sled 100 in a second longitudinal x direction back along the longitudinal path, (viii) walking back around the sled 100 to the first end 101 of the sled 100, and (ix) repeating steps (iii)-(viii) for as many reps as desired.

We claim:

1. A wheeled weight training sled, comprising:

a chassis having longitudinally spaced first and second ends and laterally spaced first and second sides, (b) a pair of fixed-directional rotatable wheels mounted on each of two longitudinally spaced independently rotatable axles for supporting the chassis upon a surface and rotatable for effecting reciprocating travel of the chassis along a substantially linear longitudinal path, (c) two brakes, one in operable braking communication with each of the axles for applying resistance to rotation of the associated axle, (d) a first pair of laterally spaced push handles extending upward from proximate a first longitudinal end of the chassis, (e) a second pair of laterally spaced push handles extending upward from proximate a second longitudinal end of the chassis.

2. The wheeled weight training sled of claim 1 further comprising a means for supporting weight plates on the chassis intermediate the first and second pairs of push handles.

3. The wheeled weight training sled of claim 1 wherein the chassis has a longitudinal length of between 60 and 150 cm and a lateral width of between 30 and 100 cm.

4. The wheeled weight training sled of claim 1 wherein the chassis has a vertical clearance of between 2 and 20 cm.

5. The wheeled weight training sled of claim 1 wherein the chassis has a longitudinal length and the wheelbase is at least 70% of the longitudinal length of the chassis.

6. The wheeled weight training sled of claim 1 wherein the wheelbase is at least 80 cm.

7. A tandem axle four wheeled weight training sled comprising:

(a) a chassis having longitudinally spaced first and second ends and laterally spaced first and second sides, (b) a pair of wheels mounted on each of two axles, the wheels supporting the chassis upon a surface and independently rotatable for effecting reciprocating travel of the chassis along a longitudinal path, (c) two brakes, one in operable braking communication with each of the axles for applying resistance to rotation of the associated axle, (d) a first pair of laterally spaced push handles extending upward from proximate a first longitudinal end of the chassis, and (e) a second pair of laterally spaced push handles different from the first pair of push handles extending upward from proximate a second longitudinal end of the chassis.

8. The tandem axle four wheeled weight training sled of claim 7 wherein each brake has a separate and independent adjustable braking resistance.

9. The tandem axle four wheeled weight training sled of claim 7 wherein the brakes are eddy current brakes.

10. The wheeled weight training sled of claim 7 wherein the sled has four brakes, each in operable braking communication with one of the wheels.

11. The wheeled weight training sled of claim 7 wherein the brakes each include a neutral resistance setting.

12. The wheeled weight training sled of claim 7 further comprising a basket defining a payload retention chamber configured and arranged for temporary mounting onto the chassis.

* * * * *